US009169637B2

(12) United States Patent
McCarron et al.

(10) Patent No.: US 9,169,637 B2
(45) Date of Patent: Oct. 27, 2015

(54) UNDER PURLIN INSULATION SYSTEM

(75) Inventors: Leonard Dale McCarron, Dacula, GA (US); Loni Dale McCarron, Atlanta, GA (US); Randolph Gary McCarron, Georgetown, KY (US)

(73) Assignee: Service Partners, LLC, Glen Allen, VA (US)

( * ) Notice: Subject to any disclaimer, the term of this patent is extended or adjusted under 35 U.S.C. 154(b) by 760 days.

(21) Appl. No.: 13/037,682

(22) Filed: Mar. 1, 2011

(65) Prior Publication Data

US 2011/0258955 A1 Oct. 27, 2011

Related U.S. Application Data

(60) Provisional application No. 61/309,051, filed on Mar. 1, 2010.

(51) Int. Cl.

| | |
|---|---|
| ***E04B 1/76*** | (2006.01) |
| ***E04D 12/00*** | (2006.01) |
| ***E04D 13/16*** | (2006.01) |

(52) U.S. Cl.

CPC ..... *E04B 1/7666* (2013.01); *E04D 12/002* (2013.01); *E04D 13/1625* (2013.01)

(58) Field of Classification Search

CPC . E04B 1/7666; E04D 12/002; E04D 13/1631; E04D 13/1637

USPC ..... 52/408, 63, 407.3, 404.3, 745.05, 741.4

See application file for complete search history.

(56) References Cited

U.S. PATENT DOCUMENTS

| | | | | |
|---|---|---|---|---|
| 384,923 | A | | 6/1888 | Moore |
| 718,347 | A | | 1/1903 | Haywood |
| 3,355,745 | A | | 12/1967 | Jannuzzi |
| 3,398,491 | A | | 8/1968 | Babcock |
| 3,564,784 | A | | 2/1971 | Molinger |
| 4,233,791 | A | | 11/1980 | Kuhl et al. |
| 4,318,260 | A | | 3/1982 | Siegel et al. |
| 4,391,075 | A | | 7/1983 | Musgrave |
| 4,446,664 | A | | 5/1984 | Harkins |
| 4,528,790 | A | | 7/1985 | Lo et al. |
| 4,573,298 | A | | 3/1986 | Harkins |
| 4,625,486 | A | | 12/1986 | Dickinson |
| 4,635,423 | A | * | 1/1987 | Ward ..... 52/746.1 |
| 4,637,188 | A | | 1/1987 | Crothers |
| 4,657,062 | A | | 4/1987 | Tuerk |
| 4,875,320 | A | | 10/1989 | Sparkes |
| 4,986,389 | A | | 1/1991 | Halligan, Sr. et al. |
| 5,197,239 | A | * | 3/1993 | Glynn et al. ..... 52/63 |
| 5,357,722 | A | | 10/1994 | Kessler |
| 5,406,764 | A | * | 4/1995 | Van Auken et al. ..... 52/408 |
| 5,901,518 | A | | 5/1999 | Harkins |
| 6,003,282 | A | | 12/1999 | Alderman et al. |
| 6,094,883 | A | | 8/2000 | Atkins |
| 6,182,790 | B1 | | 2/2001 | Denny et al. |
| 6,247,288 | B1 | | 6/2001 | Harkins |
| 6,363,684 | B1 | | 4/2002 | Alderman et al. |
| 6,393,797 | B1 | | 5/2002 | Romes |

(Continued)

*Primary Examiner* — Adriana Figueroa
*Assistant Examiner* — Jessie Fonseca
(74) *Attorney, Agent, or Firm* — Carlson, Gaskey & Olds, PC

(57) ABSTRACT

A method for installing a vapor bather in a building includes loosely hanging a strip around a periphery of an area to be insulated, providing a vapor bather having a plurality of attachments, the attachments adapted to attach to the strip, attaching the attachments to the strip, and then tightening the strip to tighten the vapor bather.

13 Claims, 3 Drawing Sheets

(56) References Cited

U.S. PATENT DOCUMENTS

| | | | | |
|---|---|---|---|---|
| 6,595,455 | B2 | 7/2003 | Romes | |
| 6,769,223 | B2 | 8/2004 | Alderman | |
| 6,868,647 | B2 | 3/2005 | Poldmaa | |
| 7,448,836 | B2 | 11/2008 | Clarke et al. | |
| 2002/0124507 | A1 | 9/2002 | Atkins | |
| 2003/0150171 | A1 | 8/2003 | Kunzel et al. | |
| 2003/0167718 | A1* | 9/2003 | Alderman | 52/407.3 |
| 2010/0024325 | A1* | 2/2010 | Robbins et al. | 52/173.1 |
| 2011/0061311 | A1* | 3/2011 | Peng et al. | 52/23 |

* cited by examiner

UNDER PURLIN INSULATION SYSTEM

RELATED APPLICATION

This application claims priority to U.S. Provisional Application No. 61/309,051, which was filed Mar. 1, 2010.

BACKGROUND

As natural resources, particularly those required for heating and cooling, become scarcer, consumers and businesses are trying to utilize better technologies to lower the cost of energy and the like. Likewise, local governments and industry groups are promulgating new standards for energy compliance.

For instance, ASHRAE (The American Society of Heating, Refrigerating and Air Conditioning Engineers), has promulgated standards that will require that new conditioned air low-rise commercial construction will require roof u-values of between 0.035-0.040 and wall u-values of 0.050-0.060. This is a significant change from its current u-value of 0.062 for the roof.

SUMMARY

According to an embodiment shown herein, a method for installing a vapor barrier in a building includes loosely hanging a strip around a periphery of an area to be insulated, providing a vapor barrier having a plurality of attachments, the attachments adapted to attach to the strip, attaching the strip attachments to the strip, and then tightening the strip to tighten the vapor barrier.

According to a further embodiment shown herein, a method for installing insulation in a building includes loosely hanging a strip around a periphery of an area to be insulated, providing a web having a plurality of attachments, the attachments adapted to attach to the strip, attaching the strip attachments to the strip, and tightening the strip.

According to a further embodiment shown herein, a method for installing a vapor barrier in a building includes attaching hangers for holding a strip at corners between supporting members of the building, loosely hanging a strip on the hangers, providing a vapor barrier having a plurality of attachments, the attachments adapted to attach to the strip, attaching the attachments to the strip, and tightening the strip.

According to a still further embodiment shown herein, an apparatus for hanging a vapor barrier in a building has a strip for attaching around a periphery of an area to be insulated, the strip being capable of being tightened, and a vapor barrier having a plurality of attachments attached to the vapor barrier away from an edge thereof to create an area of the vapor barrier, the attachments adapted to attach to the strip and the area being adaptable to attach to the building.

These and other features of the present invention can be best understood from the following specification and drawings, the following of which is a brief description.

DETAILED DESCRIPTION OF THE PREFERRED EMBODIMENT

Figures 1, 2, 2A:
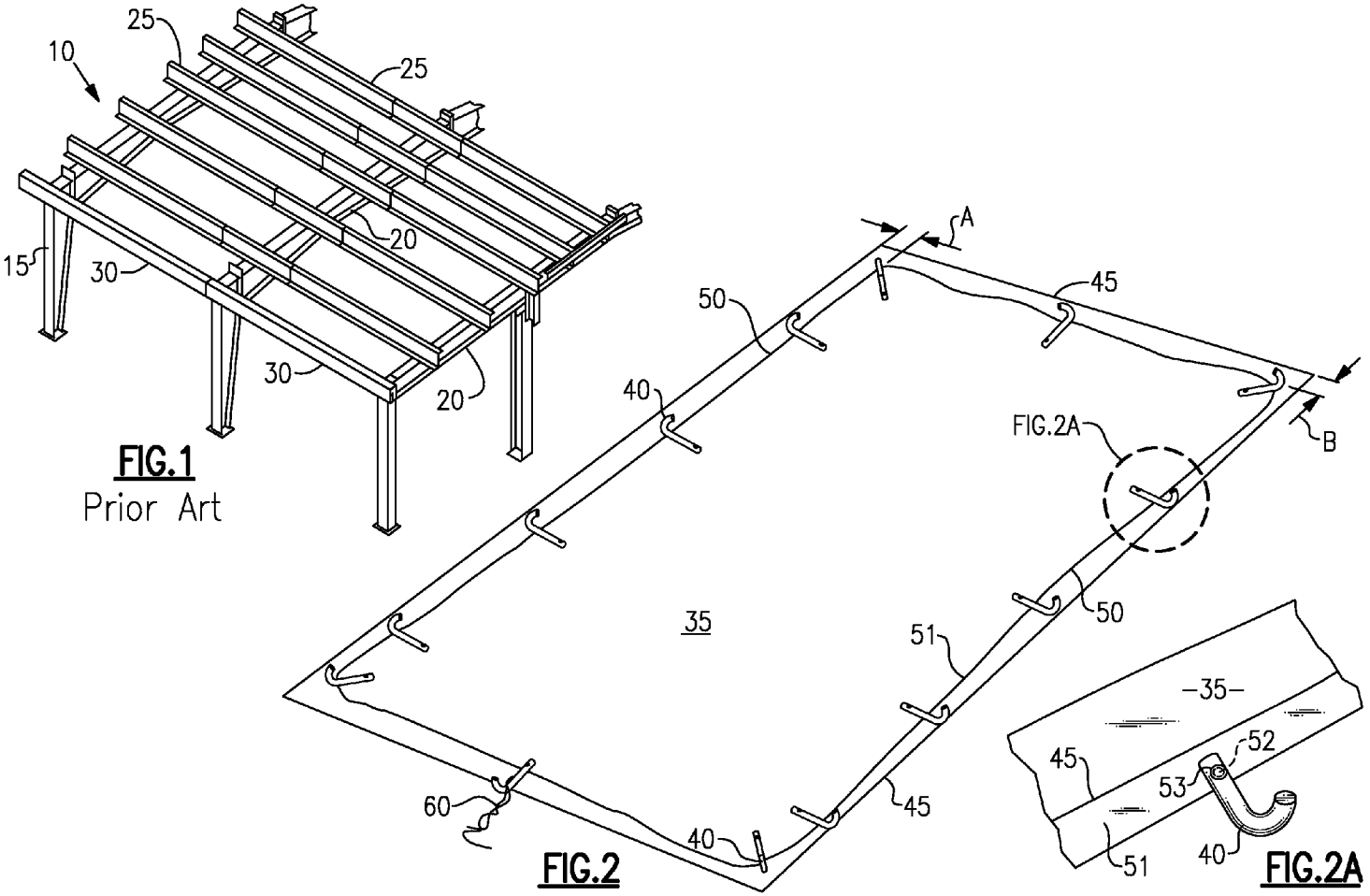
FIG.1 Prior Art
FIG. 1 is a partial perspective view of a typical low-bay building construction.
FIG. 2 is a perspective view of a vapor barrier for use in the low-bay building of FIG. 1.
FIG. 2A is an alternative embodiment for the area shown as 2A in FIG. 2.

FIG. 1 shows a typical low-rise building 10 having a plurality of posts 15 supporting a plurality of beams 20 that support a plurality of purlins 25. The posts also support a plurality of eave struts 30. The purlins are shown having a capital "Z" like shape but other shapes are contemplated. The posts 15, purlins 25, eave struts 30 and beams 20 are constructed of steel but other materials are also contemplated herein.

Referring now to FIG. 2, a vapor bather 35 for use in the building of FIG. 1 or the like is shown. The vapor barrier 35, which is typically a web of impervious fabric material, like a coated plastic, has a plurality of attachments such as hooks 40 sewn into the vapor barrier thereof (though other means of attaching the hooks to the vapor bather are contemplated). The hooks should be about 9-24 inches apart though other distances are contemplated. The hooks 40 are not at the edge 45 of the vapor barrier but are designed to attach to a flexible strip such as a wire, cord or cable 50 inside the edge 45. The material of the vapor barrier (shown as length A and B in FIG. 2) closer to the edge 45 is used to seal the vapor bather against the building 10 (see edge 45 in phantom if FIG. 4).

Referring to FIG. 2A, an alternative way of attaching the hooks 40 includes folding over the edges 45 of the vapor barrier 35 to create a double layer 51 of vapor barrier for strength. A rivet 53 is placed through a hole 52 in the hook 40 and the doubled vapor bather 51 to secure the hook to the vapor barrier.

Figure 3:
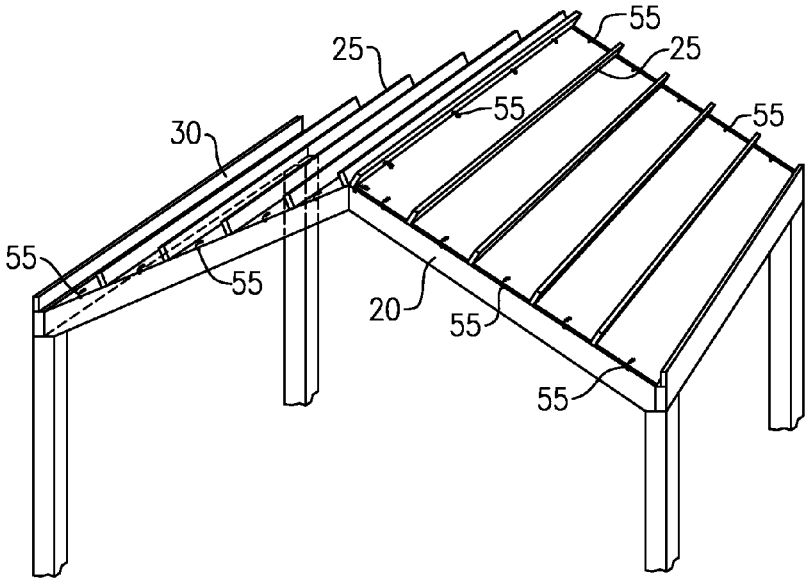
FIG. 3 is a perspective view of a low-bay building having a plurality of attachments and a wire.

Referring now to FIG. 3, a hanger such as eye hooks 55 are attached to the beams 20 and the purlins 25 at least every 20 feet or so. It is also preferred that the eye hooks 55 are placed at the corners of the eave struts 30 and the beams 20 to define a bay to be insulated. Though eye hooks are preferred because the wire or cable 50 is attached through the eyes hooks 55 and left slack, at least at first, other attachment methods are contemplated that will hold the wire and allow it to be tightened. The wire shown is one-eight inch cable though other materials are contemplated as mentioned hereinabove. The eye hooks 55 may also be placed against the beams 20 if more insulation is desired.

Figure 4:
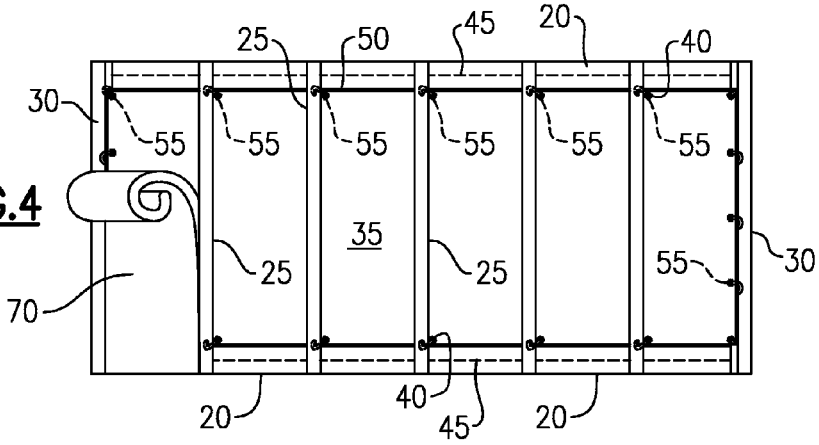
FIG. 4 is a top perspective view of the vapor barrier of FIG. 2 attached to the building of FIG. 3.

Referring now to FIG. 4, to attach the vapor barrier 35 to the wire 50, one side of the vapor barrier is secured to the wire 50 along a beam by attaching the hooks 40 in the vapor barrier along a beam to the wire 50. Then an end of the vapor barrier is secured, by attaching the hooks 40 to the wire 50 along an eave strut 30. Then the other side of the vapor barrier 35 is secured to the wire 50 attached to another purlin by attaching the hooks in the vapor barrier along the wire 50 on the other purlin 25. Then the other end of the vapor barrier 35 is secured, by attaching the hooks 40 to the wire 50 along the other eave strut 30.

Figure 5:
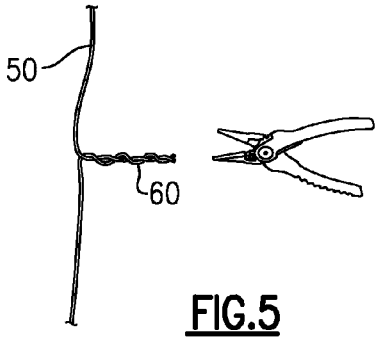
FIG. 5 is a perspective view of a tool for use with the wire used in FIG. 4.

Once both sides are installed and the vapor barrier 35 is square, the wire 50, which is loosely attached to itself at both ends 60 is tightened (see FIG. 5). The cable may be tightened with pliers 65 or come-alongs and secured by a Gripple® fastener (Gripple is a registered trademark of the Gripple Limited Corporation of East Sheffield, England) or the like (not shown) and secured together so that the tightened cables do not slip. Tightening the cable causes the cable to pull the hooks, and the vapor barrier thereby, towards the edges of the area to be insulated between the purlins 25 and the edge struts 30 thereby tightening the vapor bather 35 left to right and front to back. The vapor barrier 35 may now support insulation 70.

With the vapor bather 35 tight in place, the vapor bather 35 defined by areas A and B in FIG. 2 is placed against the beams, around the purlins and eave struts by means of adhesive or the like to create tight vapor seal.

Once the vapor barrier 35 is installed, insulation 70 is then unrolled into place from the top side of the building onto the vapor bather between the purlins 25. Because the depth of installation is dependent on where the eyehooks 55 are placed, the vapor barrier and the insulation placed atop the vapor barrier can be placed virtually anywhere below the purlins so that the purlins do not compress or interfere with the insulation and the required R-values. The eye hooks 55 can be lowered should the building owner ever require more insulation be added to the building.

Figure 6:
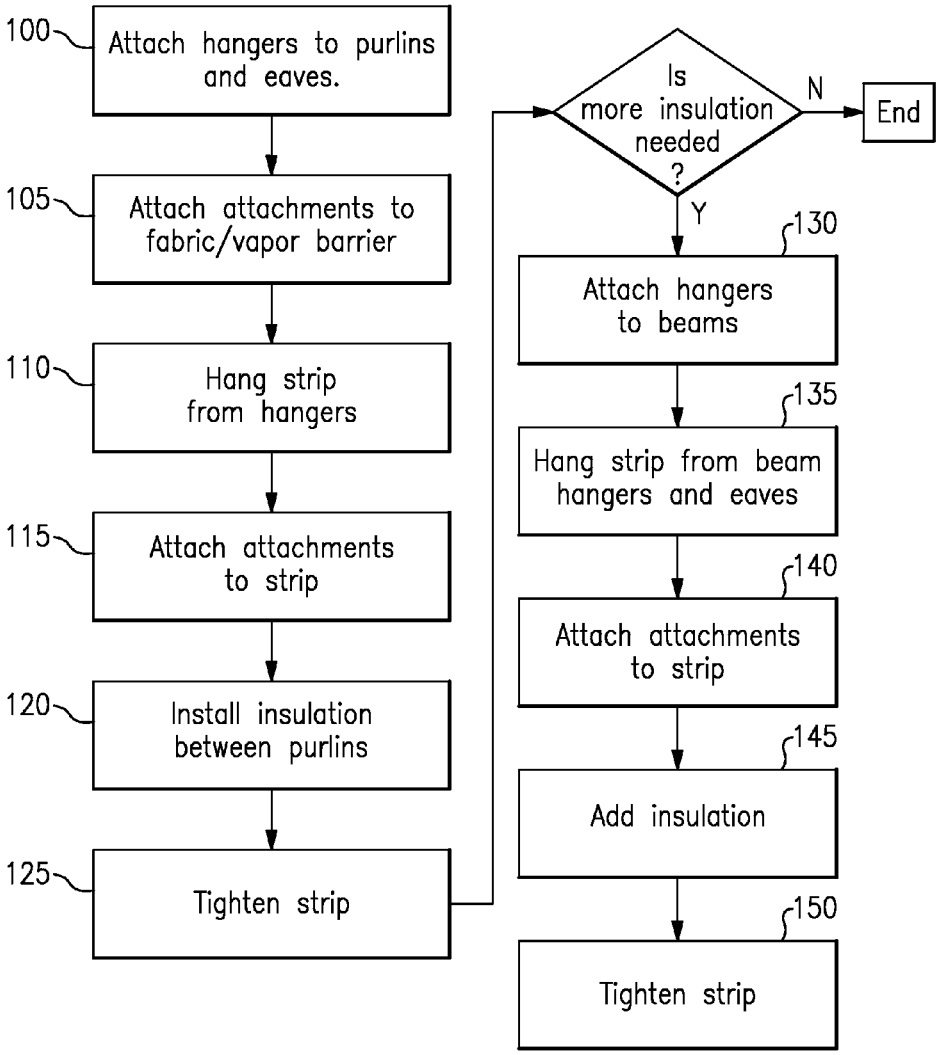
FIG. 6 is a method of using an embodiment shown in the other Figures herein.

Referring to FIG. 6, operation of the embodiments shown is shown. Hanger such as eye hooks 55 are attached to the eave struts 30 and the purlins 25 (step 100). Attachments such as hooks 40 are attached to the vapor barrier 35 (step 105). A strip such as wire 50 is hung from the hangers/eye hooks 55 (step 110) and the attachments/hooks 55 are attached to the strip/wire 50 (step 115). Insulation 70 is disposed between the purlins 25 (step 120) and the strip/wire 50 is tightened to remove the slack therein (step 125). If more insulation 70 is needed, the hangers/eye hooks 55 are attached to beams 20 (step 130) and the strip/wire 50 is then suspended from the hangers/eye hooks 55 and eave struts 30 (step 135). The attachments/hooks 55 are attached to the strip/wire 50 (step 140). More insulation 70 may be disposed between and/or below the purlins 25 (step 145) and the strip/wire 50 is tightened to remove the slack therein (step 150).

One of ordinary skill in the art will recognize that if a vapor barrier is not necessary, a web or other type of support may be used to hold the insulation in place.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A method for installing a vapor barrier in a building comprising:

loosely hanging a strip around a periphery of an area to be insulated, wherein hanging the strip is achieved by attaching hangers to said building and threading said strip through said hangers, providing a vapor barrier having a plurality of attachments, said attachments adapted to attach to said strip, attaching said attachments to said strip, and tightening said strip.

2. A method for installing insulation in a building comprising:

loosely hanging a strip around a periphery of an area to be insulated, wherein hanging the strip is achieved by attaching eyehooks to said building and threading said strip through said eyehooks, providing a web having a plurality of attachments, said attachments adapted to attach to said strip, attaching said strip attachments to said strip, and tightening said strip.

3. A method for installing a vapor barrier in a building comprising:

attaching hangers for holding a strip at corners between supporting members of said building, subsequent to attaching said hangers, loosely hanging a strip on said hangers, providing a vapor barrier having a plurality of attachments, said attachments adapted to attach to said strip, attaching said attachments to said strip, and tightening said strip.

4. The method of claim 3 further comprising:

placing insulation atop said vapor barrier from atop said building.

5. The method of claim 3 wherein said attachments are attached to said vapor barrier away from edges thereof so that a peripheral area of said vapor barrier between said attachments and said edges is loose after tightening said strip.

6. The method of claim 5 further comprising:

attaching said peripheral area of said vapor barrier to said building so that a vapor tight seal is created by said vapor barrier and said building.

7. The method of claim 3 wherein said supporting members are eave struts and purlins.

8. The method of claim 3 wherein said supporting members are eave struts and beams.

9. The method of claim 3 wherein each attachment includes a first portion fixed to said vapor barrier and a second portion that attaches to said strip, and further comprising:

fixing said first portion to said vapor barrier prior to attaching said second portion to said strip and wherein tightening said strip is performed subsequent to attaching said second portion to said strip.

10. A method for installing a vapor barrier in a building comprising:

attaching hangers for holding a strip at corners between supporting members of said building, wherein said supporting members comprise one or more of beams, eave struts, and purlins, loosely hanging a strip on said hangers, providing a vapor barrier having a plurality of attachments, said attachments adapted to attach to said strip, attaching said attachments to said strip, and tightening said strip, loosening said strip and adding insulation between and/or below said purlins.

11. The method of claim 10 further comprising:

attaching hangers to said members that are beams.

12. The method of claim 11 further comprising:

adding insulation between and/or below said purlins.

13. The method of claim 11 further comprising hanging said strip from said hanger on said beams.

* * * * *